US010815453B2

(12) United States Patent
Sutton, Jr. et al.

(10) Patent No.: US 10,815,453 B2
(45) Date of Patent: Oct. 27, 2020

(54) DISINFECTANT CLEANING COMPOSITION WITH QUATERNARY AMMONIUM HYDROXYCARBOXYLATE SALT AND QUATERNARY AMMONIUM ANTIMICROBIAL

(71) Applicant: S.C. Johnson & Son, Inc., Racine, WI (US)

(72) Inventors: Art Daniels Sutton, Jr., Mebane, NC (US); Lisa Ann Flugge-Berendes, Kenosha, WI (US); Gerald M. Davis, Racine, WI (US); Michael Scott Haas, Franklin, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 16/342,737

(22) PCT Filed: Oct. 17, 2017

(86) PCT No.: PCT/US2017/056931
§ 371 (c)(1),
(2) Date: Apr. 17, 2019

(87) PCT Pub. No.: WO2018/080836
PCT Pub. Date: May 3, 2018

(65) Prior Publication Data

US 2020/0048585 A1 Feb. 13, 2020

Related U.S. Application Data

(60) Provisional application No. 62/413,195, filed on Oct. 26, 2016.

(51) Int. Cl.

| | |
|---|---|
| ***C11D 1/62*** | (2006.01) |
| ***C11D 17/00*** | (2006.01) |
| ***B08B 3/08*** | (2006.01) |
| ***C11D 1/72*** | (2006.01) |
| ***C11D 1/75*** | (2006.01) |
| ***C11D 1/83*** | (2006.01) |
| ***C11D 3/30*** | (2006.01) |
| ***C11D 3/33*** | (2006.01) |
| ***C11D 3/48*** | (2006.01) |
| ***C11D 3/50*** | (2006.01) |
| ***C11D 11/00*** | (2006.01) |
| *C11D 1/14* | (2006.01) |

(52) U.S. Cl.
CPC ..... *C11D 17/0008* (2013.01); *B08B 3/08* (2013.01); *C11D 1/72* (2013.01); *C11D 1/75* (2013.01); *C11D 1/83* (2013.01); *C11D 3/30* (2013.01); *C11D 3/33* (2013.01); *C11D 3/48* (2013.01); *C11D 3/50* (2013.01); *C11D 11/0023* (2013.01); *C11D 1/146* (2013.01)

(58) Field of Classification Search
CPC .. C11D 1/12; C11D 1/143; C11D 1/62; C11D 1/65; C11D 1/75; C11D 1/722; C11D 1/835; C11D 3/33; C11D 3/48
See application file for complete search history.

(56) References Cited

U.S. PATENT DOCUMENTS

| | | | | |
|---|---|---|---|---|
| 4,284,435 | A | 8/1981 | Fox | |
| 4,551,506 | A | 11/1985 | Gosselink | |
| 5,414,124 | A | 5/1995 | Smith et al. | |
| 5,441,541 | A | 8/1995 | Mehreteab et al. | |
| 5,472,455 | A | 12/1995 | Mehreteab et al. | |
| 5,552,089 | A | 9/1996 | Misselyn et al. | |
| 5,554,320 | A | 9/1996 | Yianakopoulos | |
| 5,798,329 | A | 8/1998 | Taylor et al. | |
| 5,827,451 | A | 10/1998 | Cummings et al. | |
| 5,939,059 | A | 8/1999 | Franklin et al. | |
| 5,962,388 | A | 10/1999 | Sherry et al. | |
| 5,994,602 | A | 11/1999 | Abdul-Sada et al. | |
| 6,087,303 | A * | 7/2000 | Walker | A01N 33/12 106/15.05 |
| 6,462,014 | B1 | 10/2002 | Johnson et al. | |
| 6,465,403 | B1 | 10/2002 | Skee | |
| 6,509,012 | B1 | 1/2003 | Hossel et al. | |
| 6,544,350 | B2 | 4/2003 | Muller et al. | |
| 6,573,405 | B1 | 6/2003 | Abbott et al. | |

(Continued)

FOREIGN PATENT DOCUMENTS

| | | |
|---|---|---|
| EP | 0 111 965 A2 | 6/1984 |
| GB | 2067196 B | 12/1983 |

(Continued)

OTHER PUBLICATIONS

CN103849490A Abstract, Jun. 11, 2014, 1 page.
CN104293489A Abstract, Jan. 21, 2015, 1 page.
Written Opinion for PCT Application No. PCT/2017/056931, dated Jan. 3, 2018, 8 pages.
U.S. Appl. No. 16/341,743, filed Apr. 12, 2019, Davis et al.
U.S. Appl. No. 16/342,360, filed Apr. 16, 2019, Flugge-Berendes et al.

* cited by examiner

*Primary Examiner* — Charles I Boyer

(57) ABSTRACT

An aqueous cleaning composition, which may be suitable for use in cleaning hard surfaces, is described. The aqueous cleaning composition includes an N,N-dialkyl-N-aliphatic ammonium hydroxycarboxylate salt, a nonionic surfactant and/or anionic surfactant, an quaternary ammonium antimicrobial surfactant and a substantial amount of water. The aqueous cleaning composition commonly has a pH of no more than about 8 and other than an optional fragrance component, the composition is substantially free of volatile organic compounds. The cleaning compositions may also include a chelating agent, such as an aminopolycarboxylate chelating agent.

21 Claims, No Drawings

(56) References Cited

U.S. PATENT DOCUMENTS

| | | | |
|---|---|---|---|
| 6,605,584 | B2 | 8/2003 | Fong et al. |
| 6,693,070 | B1 | 2/2004 | Cheung et al. |
| 6,878,681 | B1 | 4/2005 | Gohl et al. |
| 6,953,773 | B2 | 10/2005 | Pereira et al. |
| 7,183,433 | B2 | 2/2007 | Abbott et al. |
| 7,186,675 | B2 | 3/2007 | Meine et al. |
| 7,189,685 | B2 | 3/2007 | Hubig et al. |
| 7,196,221 | B2 | 3/2007 | Abbott et al. |
| 7,235,494 | B2 | 6/2007 | Andreas |
| 7,348,303 | B2 | 3/2008 | Gallotti et al. |
| 7,544,807 | B2 | 6/2009 | Wasserscheid et al. |
| 7,588,645 | B2 | 9/2009 | Griese et al. |
| 7,737,106 | B2 | 6/2010 | Kenneally et al. |
| 7,776,810 | B2 | 8/2010 | Jordan, IV et al. |
| 7,786,064 | B1 | 8/2010 | Hecht et al. |
| 7,786,065 | B2 | 8/2010 | Hecht et al. |
| 7,863,458 | B2 | 1/2011 | Wasserscheid et al. |
| 7,880,024 | B2 | 2/2011 | Lim et al. |
| 7,923,424 | B2 | 4/2011 | Small |
| 7,928,053 | B2 | 4/2011 | Hecht et al. |
| 8,110,537 | B2 | 2/2012 | Gohl et al. |
| 8,308,824 | B2 | 11/2012 | Wood et al. |
| 8,481,474 | B1 | 7/2013 | Blattner et al. |
| 8,518,298 | B2 | 8/2013 | Abbott |
| 8,709,169 | B2 | 4/2014 | Company et al. |
| 8,716,207 | B2 | 5/2014 | Blattner et al. |
| 8,901,061 | B2 | 12/2014 | D'Ambrogio et al. |
| 9,090,855 | B2 | 7/2015 | Polzin et al. |
| 9,157,051 | B2 | 10/2015 | D'Ambrogio et al. |
| 9,359,499 | B2 | 6/2016 | Cernohous |
| 9,719,057 | B2 | 8/2017 | Nielsen et al. |
| 9,920,284 | B2 | 3/2018 | Sutton, Jr. et al. |
| 10,179,890 | B2 | 1/2019 | Sutton, Jr. et al. |
| 2003/0064910 | A1 | 4/2003 | Fong et al. |
| 2003/0089891 | A1 | 5/2003 | Andreas |
| 2003/0228991 | A1 | 12/2003 | Johnson et al. |
| 2004/0077519 | A1 | 4/2004 | Price et al. |
| 2004/0138084 | A1 | 7/2004 | Gohl et al. |
| 2004/0167057 | A1 | 8/2004 | Pereira et al. |
| 2004/0266658 | A1 | 12/2004 | Lenhart |
| 2005/0164903 | A1 | 7/2005 | Ko et al. |
| 2006/0019863 | A1 | 1/2006 | Hubig et al. |
| 2006/0084729 | A1 | 4/2006 | Clarke |
| 2006/0157089 | A1 | 7/2006 | Taylor et al. |
| 2006/0183654 | A1 | 8/2006 | Small |
| 2006/0234889 | A1 | 10/2006 | Griese et al. |
| 2006/0234890 | A1 | 10/2006 | Griese et al. |
| 2007/0010607 | A1 | 1/2007 | Smith et al. |
| 2008/0139443 | A1 | 6/2008 | Buzinski et al. |
| 2010/0099314 | A1 | 4/2010 | Hecht et al. |
| 2012/0258067 | A1 | 10/2012 | Yang et al. |
| 2013/0247308 | A1 | 9/2013 | Duerrschmidt et al. |
| 2014/0065088 | A1 | 3/2014 | Frantz et al. |
| 2014/0083465 | A1 | 3/2014 | D'Ambrogio et al. |
| 2014/0090671 | A1 | 4/2014 | D'Ambrogio et al. |
| 2014/0121291 | A1 | 5/2014 | Cernohous |
| 2016/0017262 | A1 | 1/2016 | Monster et al. |
| 2016/0151527 | A1 | 6/2016 | Holland et al. |

FOREIGN PATENT DOCUMENTS

| | | |
|---|---|---|
| WO | WO 2018/080835 | 10/2017 |
| WO | WO 2018/080839 | 10/2017 |

DISINFECTANT CLEANING COMPOSITION WITH QUATERNARY AMMONIUM HYDROXYCARBOXYLATE SALT AND QUATERNARY AMMONIUM ANTIMICROBIAL

CROSS-REFERENCE TO RELATED APPLICATIONS

This patent application is a U.S. national stage of International Application Ser. No. PCT/US2017/056931, filed on Oct. 17, 2017, which claims the benefit of U.S. Provisional Application Ser. No. 62/413,195, filed on Oct. 26, 2016; the entire contents of which are hereby incorporated by reference, for any and all purposes.

BACKGROUND

Many current cleaning products often include using a "smelly" cleaner and compensate for the unpleasant odor by the need for running a fan, opening a window, or leaving the room; using a bad smelling cleaner but then following up with an air freshener or other solution; or using a cleaner that is not as effective and put more effort into cleaning the mess. Current commercial cleaning products that perform well on the removal of soap scum or greasy soil often have an unpleasant odor. For instance, some cleaners are quite unpleasant to use and others may have a sour or bleach odor, which many consumers find objectionable. Solvents are commonly used in cleaning products to enhance soap scum and soil cleaning and removal. If solvents could be substantially eliminated, the chemical odor from those materials would be eliminated as well resulting in a better consumer experience. Fragrance development for such products would be simplified, since fragrance components that mask the solvent odor would not necessarily have to be incorporated. In addition, any fragrances that are incorporated in such cleaning products would not have to compete with solvent odor, allowing for the full hedonics of the fragrance to be experienced, enhancing the consumer experience as well.

SUMMARY

The present application relates generally to the field of cleaning compositions and, in particular, aqueous cleaning compositions which may be especially useful for cleaning hard surfaces. The present cleaning compositions typically have a relatively neutral pH, e.g., a pH of no more than about 8, such as a pH of about 5 to 8 and, more typically, about 6 to 8. The present cleaning compositions include an ionic liquid and are generally substantially free of solvent and other volatile organic compounds. In some instances, it may be desirable to include a small amount of fragrance material as the only volatile compounds in the cleaning composition. In ready to use form, the present cleaning compositions are typically aqueous compositions which include a substantial amount of water, e.g., at least about 85 wt. % and often at least about 90 wt. % or even 95 wt. % or higher. The ionic liquid component may suitably include one or more N,N-dialkyl-N-aliphatic ammonium salts, such as an N,N-dialkyl-N-aliphatic ammonium hydroxycarboxylate salt. The N,N-dialkyl-N-aliphatic ammonium hydroxycarboxylate salt(s) may include one or more N,N-di-alkyl-N—($C_{8-14}$)-aliphatic ammonium hydroxycarboxylate salts. For example, the ionic liquid may include a N,N-di-($C_{1-3}$)alkyl-N-fatty ammonium hydroxycarboxylate salt, e.g., an N,N-dimethyl-N—($C_{8-14}$)-n-alkyl ammonium hydroxycarboxylate salt. The cleaning compositions may also include a quaternary ammonium antimicrobial surfactant, such as a quaternary benzyl ammonium salt and/or a quaternary bis(alkyl)dimethylammonium salt. Quite commonly, the cleaning compositions may also include a nonionic surfactant, such as an ethoxylated alcohol and/or alkyl amine oxide, and/or an anionic surfactant, such as an alkylsulfate and/or alkylsulfonate salt. Optionally, the cleaning compositions may also include one or more adjuvants, such as a fragrance, a preservative, a complexing agent and/or a bleaching agent. Where such a cleaning composition is intended to be used as an aerosol cleaner, it may be formulated in a pressurized container together with a propellant, such as a hydrocarbon propellant, a hydrofluoroalkane propellant and/or a volatile ether propellant.

In some embodiments, the cleaning composition includes (a) N,N-dialkyl-N-aliphatic ammonium hydroxycarboxylate salt; (b) nonionic surfactant; (c) aminopolycarboxylate chelating agent; (d) quaternary ammonium antimicrobial surfactant; and (e) at least about 85 wt. % water.

In some embodiments, the cleaning composition includes (a) N,N-di-alkyl-N-aliphatic ammonium hydroxycarboxylate salt; (b) ethoxylated alcohol non-ionic surfactant; (c) chelating agent; (d) quaternary ammonium antimicrobial surfactant; and (e) at least about 85 wt. % water; wherein the composition has a pH of about 6 to 8.

In some embodiments, the cleaning composition includes (a) N,N-di-alkyl-N-aliphatic ammonium hydroxycarboxylate salt; (b) nonionic surfactant; (c) quaternary ammonium antimicrobial surfactant; and (d) at least about 75 wt. % water; wherein the composition has a pH of no more than about 8. Other than an optional fragrance component, the composition is commonly substantially free of volatile organic compounds.

In some embodiments, the cleaning composition includes (a) N,N-di-alkyl-N-aliphatic ammonium hydroxycarboxylate salt; (b) anionic surfactant; (c) quaternary ammonium antimicrobial surfactant; and (d) at least about 75 wt. % water; wherein the composition has a pH of no more than about 8. Other than an optional fragrance component, the composition is commonly substantially free of volatile organic compounds.

In some embodiments, the cleaning composition consists essentially of: (a) N,N-dialkyl-N-fatty ammonium hydroxycarboxylate salt, e.g., an N,N-di-($C_1$-$C_3$)alkyl-N—($C_8$-$C_{14}$) fatty ammonium hydroxycarboxylate salt; (b) ethoxylated alcohol nonionic surfactant and/or alkylsulfate anionic surfactant; (c) optionally, quaternary ammonium antimicrobial surfactant; (d) optionally, aminopolycarboxylate chelating agent; (e) optionally, a hydroxycarboxylic acid, such as citric and/or lactic acid; (f) optionally, one or more adjuvants, such as a fragrance, preservative and/or bleaching agent, and (g) a balance of water. Such cleaning compositions desirably may have a pH of about 5 to 8 and as a result small amounts of pH adjusting agents (e.g., sodium hydroxide or citric acid) may be added to the composition to achieve the desired final pH. Examples of suitable N,N-dialkyl-N-fatty ammonium hydroxycarboxylate salts include N,N-dimethyl-N—($C_8$-$C_{14}$)fatty ammonium hydroxycarboxylate salts, such as N,N-dimethyl-N-octylammonium citrate, N,N-dimethyl-N-decylammonium citrate and N,N-dimethyl-N-dodecylammonium citrate.

In one particular embodiment, the cleaning composition may have a pH of about 5 to 8 and include (a) about 0.05 to 4 wt. % N,N-dimethyl-N-decylammonium citrate; (b) about 0.1 to 1 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)dimethylammonium chloride; (c) about 0.2 to 5 wt. % ethoxylated having an average degree of ethoxylation of about 6 to 10; (d) about 0.2 to 2 wt. % iminodisuccinate sodium salt and/or glutamate diacetic acid sodium salt; and (e) at least about 90 wt. % water; wherein other than an optional fragrance component the composition is substantially free of volatile organic compounds. Such cleaning compositions may optionally include a fragrance material, e.g., about 0.1 to 0.3 wt. % fragrance material.

In another particular embodiment, the aqueous cleaning composition can include (a) N,N-dialkyl-N-aliphatic ammonium hydroxycarboxylate salt; (b) nonionic surfactant, e.g., ethoxylated aliphatic alcohol and/or alkyl amine oxide, and/or an anionic surfactant, e.g., an alkylsulfate salt and/or alkylsulfonate salt; (c) quaternary ammonium antimicrobial surfactant; and (d) at least about 85 wt. % water. Such aqueous cleaning compositions typically have a pH of about 5 to 8. Other than an optional fragrance component, the compositions are substantially free (e.g., <0.1 wt. %) of glycol ether solvents, aliphatic alcohol solvents, polyol solvents and amino alcohol solvents. Often, other than an optional fragrance component, the compositions are substantially free of volatile organic compounds.

In another particular embodiment, the aqueous cleaning composition can include (a) N,N-dialkyl-N-aliphatic ammonium hydroxycarboxylate salt; (b) anionic surfactant; (c) quaternary ammonium antimicrobial surfactant; and (d) at least about 85 wt. % water. Such aqueous cleaning compositions typically have a pH of about 5 to 8 and, other than an optional fragrance component, are substantially free of volatile organic compounds.

While the aqueous cleaning composition commonly includes an N,N-dialkyl-N-aliphatic ammonium hydroxycarboxylate salt, in some embodiments other salts of such ammonium compounds may be used. For example, the cleaning composition may include an N,N-dialkyl-N-aliphatic ammonium mineral salt in which the counter anion is a halide anion (e.g., Cl–, Br–, I–), Other suitable N,N-dialkyl-N-aliphatic ammonium salts can include other carboxylate anions, e.g., alkyl carboxylates, such as acetate salts and/or salts of $C_2$-$C_{10}$ alkanoic acids, alkylsulfate ($RSO_4^-$) salts, alkylsulfonate ($RSO_3^-$) salts, alkylphosphonate (e.g., $RPO_3^-$) salts and alkylphosphate (e.g., $R_2PO_4^-$) salts. Specific examples include acetate salts, chloride salts, and/or salts which include a methosulfate and/or ethosulfate anion.

DETAILED DESCRIPTION

The present cleaning compositions include an ionic liquid, typically have a relatively neutral pH and, other than an optional fragrance component, are generally substantially free of organic solvents and other volatile organic compounds. For example, the cleaning composition may be substantially free of glycol ether solvents, aliphatic alcohol solvents, polyol solvents and amino alcohol solvents. The present cleaning compositions are commonly environmentally friendly due to being based on a low volatile organic content (VOC) formulation. Even though having significantly lower amounts of solvents as compared to conventional hard surface cleaning compositions, no loss of performance as to cleaning is generally observed (rather improved cleaning is typically obtained). As referred to herein, a composition having a low VOC or composition substantially free of volatile organic compounds is considered to be one which, other than an optional fragrance component, the composition contains no more than 0.1 wt. % volatile organic compounds. In some embodiments, a present cleaning compositions may have an even lower VOC concentration such as ≤0.05 wt. % or ≤0.01 wt. % VOC.

In some embodiments, the present aqueous cleaning composition includes (a) N,N-dialkyl-N-aliphatic ammonium hydroxycarboxylate salt; (b) nonionic surfactant and/or anionic surfactant; (c) quaternary ammonium antimicrobial surfactant; and (d) at least about 85 wt. % water. The N,N-dialkyl-N-aliphatic ammonium hydroxycarboxylate salt typically includes one or more N,N-di-($C_1$-$C_3$)alkyl-N—($C_8$-$C_{14}$)aliphatic ammonium hydroxycarboxylate salts, such as an N,N-dimethyl-N—($C_8$-$C_{14}$)alkylammonium citrate and/or an N,N-dimethyl-N—($C_8$-$C_{14}$)alkylammonium lactate. N,N-dimethyl-N-alkylammonium salts are also referred to herein as N-alkyl dimonium salts. In many instances, the N,N-di-($C_1$-$C_3$)alkyl-N—($C_8$-$C_{14}$)aliphatic ammonium hydroxycarboxylate salt(s) comprises N,N-dimethyl-N—($C_8$-$C_{14}$)-n-alkylammonium citrate and/or lactate, such as N,N-dimethyl-N-n-octylammonium citrate, N,N-dimethyl-N-n-decylammonium citrate (also referred to as N-decyl dimonium citrate), N,N-dimethyl-N-n-dodecylammonium citrate (also referred to as N-lauryl dimonium citrate).

Additional examples of suitable N,N-dialkyl-N-aliphatic ammonium hydroxycarboxylate salts include N,N-dimethyl-N-coco alkylammonium hydroxycarboxylate salts. The N-coco alkyl dimonium hydroxycarboxylate salts may suitably include N-coco alkyl dimonium citrate and N-coco alkyl dimonium lactate. Specific suitable examples include N-lauryl dimonium citrate, N-palmityl dimonium citrate, N-myristyl dimonium citrate, N-lauryl dimonium lactate, N-palmityl dimonium lactate, and/or myristyl dimonium lactate.

In the present compositions, the N,N-dialkyl-N-aliphatic ammonium hydroxycarboxylate salt commonly includes an N,N-di-($C_1$-$C_3$)alkyl-N—($C_8$-$C_{14}$)-n-alkylammonium hydroxycarboxylate, such as an N,N-dialkyl-N—$C_{8-14}$-fatty alkylammonium hydroxycarboxylate salt. For example, in some embodiments the cleaning composition includes N-octyl dimonium citrate, N-decyl dimonium citrate, N-lauryl dimonium citrate, and/or N-myristyl dimonium citrate. In other embodiments, the cleaning composition may include N-octyl dimonium N-octyl dimonium lactate, N-decyl dimonium lactate, N-lauryl dimonium citrate and/or N-myristyl dimonium citrate. Typically, the present aqueous cleaning composition includes about 0.5 to 5 wt. % and, more commonly, about 1 to 4 wt. % of the N,N-dialkyl-N-aliphatic ammonium hydroxycarboxylate salt, such as an N,N-dimethyl-N—$C_{8-12}$-n-alkylammonium citrate.

In the present compositions, the N,N-dialkyl-N-aliphatic ammonium hydroxycarboxylate salts may suitably be an ionic liquid formed from the reaction of one or more equivalents of an N,N-dialkyl-N-aliphatic amine with a hydroxycarboxylic acid, such as citric acid, tartaric acid, lactic acid, glucaric acid, gluconic acid and/or malic acid. For example, such ammonium hydroxycarboxylate salts formed from citric acid may include 1, 2 or 3 equivalents of amino cation, but typically are formed from the reaction of a 3:1 mole ratio of the tertiary amine and citric acid.

The nonionic surfactant may be an alkoxylated alcohol, such as an ethoxylated ($C_{10}$-$C_{15}$) linear or branched aliphatic alcohol. The ethoxylated alcohol may have an average of about 5-15, typically 5 to 10 ethylene oxide groups. Examples of suitable alkoxylated alcohol nonionic surfactants include ethoxylated $C_{8-16}$-aliphatic alcohol have an average degree of ethoxylation of about 5 to 12. The ethoxylated $C_{8-16}$-aliphatic alcohol may include ethoxylated $C_{8-16}$-Guerbet alcohol, other secondary ethoxylated $C_{8-16}$-aliphatic alcohol and/or ethoxylated $C_{8-16}$-n-alkanol. Quite commonly the ethoxylated alcohol non-ionic surfactant includes an ethoxylated $C_{10-15}$-alkanol having an average degree of ethoxylation of about 5 to 10. When the cleaning compositions include an alkoxylated alcohol nonionic surfactant, the composition typically includes about 0.1 to 5 wt. % and, more commonly, about 0.5 to 3 wt. % of the alkoxylated alcohol. For example, the cleaning compositions may include about 0.5 to 5 wt. % of an ethoxylated alcohol, such as an ethoxylated $C_{10-15}$-alkanol, which may suitably having an average degree of ethoxylation of about 5 to 10.

Nonlimiting examples include ethoxylated long chain $C_{10}$-Guerbet alcohols, such as those produced by BASF and sold under the trade names LUTENSOL® XL100, LUTENSOL® XL80, LUTENSOL® XL70, LUTENSOL® XL60 and LUTENSOL® XP80 and. Particularly suitable nonionic surfactants include ethoxylated $C_{10}$-Guerbet alcohols having an HLB of from about 10 to about 15, commonly from about 12 to about 15. Examples include LUTENSOL XL80—an ethoxylated $C_{10}$-Guerbet alcohol with an average of 8 ethylene oxide (EO) groups, LUTENSOL® XL100—an ethoxylated $C_{10}$-Guerbet alcohol with an average of 10 EO groups, and an ethoxylated $C_{10}$-Guerbet alcohol having an HLB of about 13, such as the surfactant produced by BASF Corp. and sold under the trade name LUTENSOL® XL70.

Other examples of suitable nonionic surfactants include ethoxylated linear alcohols, such as ethoxylated linear alcohols having a $C_{10}$-$C_{15}$ n-alkyl group. Nonlimiting examples include LUTENSOL® TDA 10 (produced by BASF)—an ethoxylated tridecyl alcohol having an average of 10 EO groups, Genapol® LA 070S—an ethoxylated lauryl alcohol having an average of 7 EO groups, Tomadol® 91-6—a $C_9$-$C_{11}$ ethoxylated alcohol having an average of 6 EO groups, and LUTENSOL® AO-8—a synthetic $C_{13}$-$C_{15}$ ethoxylated oxo alcohol having an average of 8 EO groups.

Particularly suitable nonionic surfactants for use in the present cleaning compositions include ethoxylated fatty alcohols, e.g., ethoxylated $C_{12}/C_{14}$ fatty alcohols having a degree of ethoxylation of about 5 to 12 (5-12 EO) and more suitably a degree of ethoxylation of about 6 to 10; ethoxylated oxo alcohols, e.g., ethoxylated $C_{11}$-$C_{13}$ oxo alcohols having a degree of ethoxylation of about 5 to 15 and more suitably a degree of ethoxylation of about 5 to 10; ethoxylated Guebert alcohols, e.g., ethoxylated $C_{10}$ Guebert alcohols having a degree of ethoxylation of about 5 to 15 and more suitably a degree of ethoxylation of about 5 to 12; and ethoxylated secondary alcohols, e.g., ethoxylated secondary alcohols having a degree of ethoxylation of about 5 to 15 and more suitably a degree of ethoxylation of about 5 to 10.

Additional suitable nonionic surfactants include alkyl amine oxides, such as linear alkyl amine oxides. Typical alkyl amine oxides include water-soluble amine oxides of the formula $R^1$—$N(R^2)(R^3)O$ where $R^1$ is typically a $C_8$-$C_{18}$ alkyl moiety and the $R^2$ and $R^3$ moieties are typically selected from the group consisting of hydrogen, $C_1$-$C_3$ alkyl groups and $C_1$-$C_3$ hydroxyalkyl groups. Quite often, the alkyl amine oxide is a linear alkyl amine oxide where $R^1$ is a $C_8$-$C_{18}$ n-alkyl and $R^2$ and $R^3$ are methyl, ethyl, propyl, isopropyl, 2-hydroxethyl, 2-hydroxypropyl and/or 3-hydroxypropyl. The linear amine oxide surfactants in particular may include linear $C_8$-$C_{14}$ alkyl dimethyl amine oxides and linear $C_8$-$C_{12}$-alkoxyethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide). When the cleaning compositions include an amine oxide nonionic surfactant, the composition typically includes about 0.1 to 5 wt. % and, more commonly, about 0.5 to 3 wt. % of the amine oxide.

Further nonionic surfactants which may be optionally present in the aqueous cleaning compositions are alkyl polyglycosides. Suitable alkyl polyglycosides include known nonionic surfactants which are alkaline and electrolyte stable. Alkyl mono and polyglycosides are generally prepared by reacting a monosaccharide, or a compound hydrolysable to a monosaccharide with an alcohol such as a fatty alcohol in an acid medium. The fatty alcohol may have from about 8 to 30 and typically 8 to 18 carbon atoms. Examples of such alkylglycosides include, APG 325 CS GLYCOSIDE which is reported to be a 50% C9-C11 alkyl polyglycoside (commercially available from Henkel Corp, Ambler Pa.) and GLUCOPON® 625 CS which is reported to be a 50% C10-C16 alkyl polyglycoside.

The cleaning composition may contain an anionic surfactant component. Anionic surfactants are often desirably included in cleaning compositions because of their wetting and detersive properties. Suitable examples of anionic surfactants include anionic sulfonate and/or sulfate surfactants. For example, the anionic surfactant component may include alkyl sulfate, alkyl ether sulfate, alkyl sulfonate and/or alkyl ether sulfonate surfactants. Suitable alkyl sulfates include those typically having an $C_8$-$C_{18}$ alkyl group. In some instances the alkyl sulfates suitably contain a secondary alkyl group. Examples of suitable alkyl sulfates include, but are not limited to, sodium octyl sulfate, sodium decyl sulfate, sodium lauryl sulfate, sodium lauryl/myristyl sulfate and mixtures thereof. Suitable alkane sulfonates that can be used in the cleaning composition may desirably have an alkane group having 8 to 22 carbon atoms. The alkyl sulfonates may include a secondary alkane sulfonate and/or alpha olefin sulfonate. The secondary alkane sulfonate may suitably include sodium $C_{14}$-$C_{17}$ secondary alkyl sulfonate (commercially available as Hostapur SAS from Clariant). Suitable alpha olefin sulfonates include those having alpha olefin groups containing 10 to 18 carbon atoms. Suitable alkyl ether sulfates may have about 1 to 10 repeating alkoxy groups, e.g., about 1 to 5 repeating ethoxy groups. In general, the alkoxy group will contain between about 2 and about 4 carbon atoms and, commonly is an ethoxy group. One example of a suitable alkyl ether sulfate is sodium lauryl ether sulfate (sodium laureth sulfate). When the cleaning compositions include an anionic surfactant component, the composition typically includes about 0.1 to 5 wt. % and, more commonly, about 0.5 to 3 wt. % anionic surfactant.

When the present cleaning composition includes an anionic surfactant component, quite commonly the composition includes an alkyl sulfate salt and/or alkyl sulfonate salt. For example, the cleaning composition may include a sodium $C_{8-12}$-alkyl sulfate, such as sodium lauryl and/or sulfate sodium octyl sulfate. In other embodiments, the cleaning composition may include an ethoxylated fatty alcohol sulfate and/or sulfonate ester, such as sodium laureth sulfate, as an anionic surfactant.

As discussed above, the present cleaning compositions include an antimicrobial quaternary ammonium surfactant, such as a quaternary benzyl ammonium salt and/or a quaternary dialkyl ammonium salt. For example, the present cleaning compositions may include an N-(n-$C_{12-16}$)-alkyl-N-benzyl dimethylammonium chloride, an N-(n-$C_{12-16}$)-alkyl-N-ethylbenzyl dimethylammonium chloride and/or a bis(n-$C_{8-12}$-alkyl)dimethylammonium chloride. When the cleaning compositions include an antimicrobial quaternary ammonium surfactant, it is typically present at about 0.05 to 1 wt. % and, more commonly, about 0.1 to 0.4 wt. % of the composition.

In some embodiments, the antimicrobial quaternary ammonium surfactant may include a quaternary benzyl ammonium surfactant. The quaternary benzyl ammonium surfactant may include an N-alkyl-N,N-dimethyl (optionally substituted)benzyl ammonium salt. In some embodiments, the antimicrobial quaternary ammonium surfactant may include N—$C_{10-18}$-alkyl-N,N-dimethyl benzyl ammonium halide and/or N—$C_{10-18}$-alkyl-N,N-dimethyl ethylbenzyl ammonium halide. In another embodiment, the antimicrobial quaternary ammonium surfactant may include N—$C_{12-14}$-alkyl-N,N-dimethyl benzyl ammonium chloride and/or N—$C_{12-14}$-alkyl-N,N-dimethyl ethylbenzyl ammonium chloride. In some embodiments, the antimicrobial quaternary ammonium surfactant may include N-n-$C_{12-14}$-alkyl-N,N-dimethyl benzyl ammonium chloride and/or N-n-$C_{12-14}$-alkyl-N,N-dimethyl ethylbenzyl ammonium chloride.

In some embodiments, the antimicrobial quaternary ammonium surfactant may include a quaternary dialkyl ammonium surfactant. Examples of suitable quaternary dialkyl ammonium surfactants include N,N-di-$C_{8-18}$-alkyl-N,N-dimethyl ammonium halides, such as bis(n-$C_{8-12}$-alkyl) dimethylammonium chlorides. In some embodiments, the antimicrobial quaternary ammonium surfactant may include N,N-dioctyl-N,N-dimethyl ammonium chloride, N,N-didecyl-N,N-dimethyl ammonium chloride and N-octyl-N-decyl-N,N-dimethyl ammonium chloride.

Examples of the antimicrobial quaternary ammonium surfactants include, but are not limited to, BTC® 885 (available from Stepan Company), BTC® 888 (available from Stepan Company), BTC® 2125M (available from Stepan Company), Bardac 2280 (available from Lonza), Barquat MB-80 (available from Lonza), Bardac 2250 (available from Lonza), and Carboquat H (available from Lonza). BTC® 885 is a quaternary ammonium antimicrobial surfactant which is a mixture of n-alkyl (50% C14, 40% C12, 10% C16) dimethyl benzyl ammonium chloride (20%), n-octyl, n-decyl dimethyl ammonium chloride (15), di-n-octyl dimethyl ammonium chloride (7.5%), and di-n-decyl dimethyl ammonium chloride (7.5%). BTC® 888 is a mixture of n-alkyl (50% C14, 40% C12, 10% C16) dimethyl benzyl ammonium chloride (32%), n-octyl, n-decyl dimethyl ammonium chloride (24%), di-n-octyl dimethyl ammonium chloride (12%), and di-n-decyl dimethyl ammonium chloride (12%). BTC® 2125M is a mixture of n-alkyl (60% C14, 30% C16, 5% C12, 5% C18) dimethyl benzyl ammonium chloride and n-alkyl (68% C12, 32% C14) dimethyl ethylbenzyl ammonium chloride. Bardac 2280 is N,N-Didecyl-N,N-dimethylammoniumchloride. Barquat MB-80 is a mixture of n-alkyl (50% C14, 40% C12, 10% C16) dimethyl benzyl ammonium chloride salts. Bardac 2250 is di-n-decyl dimethyl ammonium chloride. Carboquat H is a mixture di-n-decyl dimethyl ammonium carbonate and bicarbonate salts.

In some aspects, the cleaning composition may optionally include a chelating agent. Suitable chelating agents include aminopolycarboxylate chelating agents, such as an iminodisuccinate salt and/or an ethylenediaminetetraacetate salt. Other suitable aminopolycarboxylate chelating agents include salts of hydroxyethylethylenediaminetriacetate (HEEDTA), 2-hydroxyethyliminodiacetate (HEIDA), and/or nitrilotriacetate (NTA). Other suitable aminopolycarboxylate chelating agents include glutamate diacetic acid salts, diethylenetriaminepentaacetic acid salts (DETAPA), triethylenetetraminehexaacetic acid salts (TETAHA), 1,3-diamino-2-hydroxypropane-N,N,N',N'-tetraacetic acid salts, and/or 1,2-diaminocyclohexane-N,N,N',N'-tetraacetic acid salts. In some instances, the cleaning composition may also include an alkali metal of the aminopolycarboxylate chelating agent, typically a sodium or potassium salt of the chelating agent. For example, the cleaning composition may also include an alkali metal of iminodisuccinic acid, e.g., tetrasodium iminodisuccinate, and/or an alkali metal sodium salt glutamate diacetic acid, e.g., the tetrasodium salt glutamate diacetic acid. Commonly, where an aminopolycarboxylate chelating agent is present in the cleaning composition, the composition includes a sodium salt of iminodisuccinic acid and/or a sodium salt of glutamate diacetic acid.

The present cleaning compositions may also include additional components or agents, such as additional functional materials (which may also be referred to as "adjuvants"). In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present cleaning preparations containing the ionic liquids may optionally contain other soil-digesting components, surfactants, disinfectants, detergent fillers, sanitizers, acidulants, complexing agents, biocides, corrosion inhibitors, anti-redeposition agents, foam inhibitors, dyes, bleaching agents, enzymes, enzyme stabilizing systems, thickening or gelling agents, wetting agents, dispersants, stabilizing agents, and/or fragrances.

For example, the aqueous cleaning compositions may also include various adjuvants as is conventional for hard surface cleaners. Examples of such adjuvants include one or more of a fragrance, preservative, dyes, corrosion inhibitors, antioxidants and the like. Adjuvants are generally present in an amount less than about 0.5 wt. % and commonly are present in an amount of about 100 ppm to about 0.2 wt. % of the composition. Quite commonly, the present the aqueous cleaning compositions may include a fragrance material and a preservative.

In another aspect, the present technology provides a method for cleaning a hard surface that includes applying any of the cleaning composition disclosed herein to a hard surface; wherein the hard surface includes a first concentration of soap scum. The method further comprising removing the composition from the hard surface; wherein the hard surface includes a second concentration of soap scum and the second concentration of soap scum may be at least about 50% less than the first concentration of soap scum. In some embodiments, the second concentration of soap scum may be at least about 60%, at least about 70%, or at least about 80% less than the first concentration of soap scum. Typically, the removal of the composition from the hard surface is conducted by scrubbing by hand. In some embodiments, the removal of the composition from the hard surface is conducted by rinsing with water that is not highly pressurized (e.g., sink or shower facet water).

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

EXAMPLES

The following examples more specifically illustrate protocols for preparing aqueous cleaning compositions according to various embodiments described above. These examples should in no way be construed as limiting the scope of the present technology.

Soap Scum Test.

The following test was used to evaluate the cleaning capability of various cleaning compositions to remove soap scum from a hard surface (Soap Scum Test-"SS"). The following is a brief description of the "soap scum" removal test.

SOIL AND TEST PLATE PREPARATION:

1. SOAP SCUM SOIL IS PREPARED USING PRECIPITATED FATTY ACID SALTS.
2. TEST PLATES (TILE) ARE PRECLEANED, DRIED, AND WEIGHED PRIOR TO SOILING. THE PRESOILING WEIGHT OF EACH PLATE IS RECORDED.
3. THE SOAP SCUM SOIL IS APPLIED TO TEST PLATES IN A MANNER TO ENSURE CONSISTENCY REGARDING THE AMOUNT AND AREA OF SOIL APPLIED.
4. SOILED PLATES ARE THEN BAKED TO CURE THE SOIL. PLATES ARE COOLED TO ROOM TEMPERATURE PRIOR TO CLEANING TESTS.

CLEANING:

1. A SOILED PLATE IS SPRAYED (TRIGGER OR AEROSOL DISPENSER) WITH AN AMOUNT OF A TEST CLEANING FORMULA AND THEN THE PLATE IS PLACED ON A GARDNER SCRUBBING DEVICE.
2. A SPONGE OR OTHER CLEANING IMPLEMENT IS DAMPENED WITH WATER AND INSERTED INTO THE SCRUBBER'S SLED.
3. THE SLED IS POSITIONED ON THE TEST PLATE AND THE SCRUBBING DEVICE IS ACTIVATED.
4. AFTER A PREDETERMINED NUMBER OF CYCLES HAVE BEEN COMPLETED, THE SCRUBBING DEVICE IS STOPPED AND THE PLATE IS REMOVED.
5. THE CLEANED PLATE IS RINSED UNDER RUNNING WATER AND SET ASIDE TO AIR DRY.
6. THE CLEANING PROCEDURE IS REPEATED AS NEEDED FOR ADDITIONAL PLATES.

ASSESSMENT:

1. PLATES ARE WEIGHED AND STATISTICALLY ASSESSED TO DETERMINE THE AVERAGE PERCENT OF SOIL REMOVED ALONG WITH THE STANDARD DEVIATION (SD).
2. FORMULA TO FORMULA COMPARISONS CAN THEN BE MADE.

Example 1

Table 1 below shows the composition of a two exemplary formulations of the present aqueous cleaning compositions. These formulations include a 3:1 mole ratio of N-decyl-N, N-dimethyl amine to citric acid as the ionic liquid component ("3:1 C10DMA:Citrate"). BTC 888 is a quaternary ammonium antimicrobial surfactant which is a mixture of n-alkyl (50% C14, 40% C12, 10% C16) dimethyl benzyl ammonium chloride, n-octyl, n-decyl dimethyl ammonium chloride, di-n-octyl dimethyl ammonium chloride and di-n-decyl dimethyl ammonium chloride. The results of the Soap Scum Test ("SS") shown in Table 2 demonstrate the effectiveness of these formulations to remove soap scum from a hard surface.

TABLE 1

| | X1-1 Wt. % | X1-2 Wt. % |
|---|---|---|
| Water | 95.4 | 95.4 |
| 3:1 C10DMA:Citrate** | 1.1 | 1.1 |
| Ethoxylated (7EO) C12 alcohol | 2.0 | 0 |
| Ethoxylated (8EO) C13 alcohol | 0 | 2.0 |
| BTC 888 | 0.32 | 0.32 |
| Fragrance | 0.15 | 0.15 |
| IDSA* | 1.0 | 1.0 |

*tetrasodium iminodisuccinic acid
**C10DMA is N-decyl-N,N-dimethyl amine

TABLE 2

| Formulas Tested | Ave. % SS Removed | SD | Levels |
|---|---|---|---|
| Multi-Surface Disinfectant (control) | 94.48 | 3.62 | A |
| X1-1 | 85.29 | 1.76 | B |
| X1-2 | 85.05 | 1.95 | B |

Example 2

Table 3 below shows the composition of three exemplary formulations of the present aqueous cleaning compositions. These formulations include a 3:1 mole ratio of N-decyl-N, N-dimethyl amine to citric acid as the ionic liquid component ("3:1 C10DMA:Citrate"). The results of the Soap Scum Test ("SS") shown in Table 4 demonstrate the relative effectiveness of these formulations to remove soap scum from a hard surface. Barquat MB-80, Bardac 2250 and Carboquat H are a quaternary ammonium antimicrobial surfactants. Barquat MB-80 is a mixture of n-alkyl (50% C14, 40% C12, 10% C16) dimethyl benzyl ammonium chloride salts. Bardac 2250 is di-n-decyl dimethyl ammonium chloride. Carboquat H is a mixture di-n-decyl dimethyl ammonium carbonate and bicarbonate salts.

TABLE 3

| | X2-1 Wt. % | X2-2 Wt. % | X2-3 Wt. % |
|---|---|---|---|
| Water | 92.95 | 92.95 | 93.40 |
| Ethoxylated (7EO) C12 alcohol | 2.0 | 2.0 | 2.0 |
| 3:1 C10DMA:Citrate** | 0.55 | 0.55 | 0.55 |
| Barquat MB-80 | 0 | 0 | 0.75 |
| Bardac 2250 | 1.2 | 0 | 0 |
| Carboquat H | 0 | 1.2 | 0 |
| Fragrance | 0.15 | 0.15 | 0.15 |
| ISDA* | 1.0 | 1.0 | 1.0 |

*tetrasodium iminodisuccinic acid
**C10DMA is N-decyl-N,N-dimethyl amine

TABLE 4

| Formulas Tested | Ave. % SS Removed | SD | Levels |
|---|---|---|---|
| Multi Surface Disinfectant (control) | 96.42 | 1.27 | A |
| X2-1 | 44.23 | 1.25 | B, C |
| X2-2 | 43.37 | 1.47 | B, C |
| X2-3 | 41.47 | 3.14 | C, D |

Example 3

Table 5 below shows the composition of a number of exemplary formulations of the present aqueous cleaning compositions. These formulations include a varying mole ratio of N-decyl-N,N-dimethyl amine to citric acid as the ionic liquid component ("C10DMA:Citrate"). The amine salt was either added as a powdered solid of 1:1 C10DMA:Citrate and/or was formed by adding appropriate amounts of N-decyl-N,N-dimethyl amine and/or citric acid to water. The results of the Soap Scum Test ("SS") shown in Table 6 demonstrate the relative effectiveness of these formulations to remove soap scum from a hard surface.

TABLE 5

| | X3-1 | X3-2 | X3-3 | X3-4 | X3-5 | X3-6 |
|---|---|---|---|---|---|---|
| Water | 96.3 | 96.3 | 96.3 | 96.3 | 96.3 | 96.3 |
| Ethoxylated (7EO) C12 alcohol | 2.0 | 2.0 | 2.0 | 2.0 | 2.0 | 2.0 |
| 1:1 C10DMA:Citrate Powder (99%) | 0.54 | 0 | 0.36 | 0 | 0.27 | 0 |
| Citric acid | 0 | 0.27 | 0 | 0.18 | 0 | 0.14 |
| C10DMA | 0 | 0.27 | 0.18 | 0.36 | 0.27 | 0.4 |
| Fragrance | 0.15 | 0.15 | 0.15 | 0.15 | 0.15 | 0.15 |
| IDSA | 1.0 | 1.0 | 1.0 | 1.0 | 1.0 | 1.0 |

TABLE 6

| Formulas Tested | Ave. % SS Removed | SD | levels |
|---|---|---|---|
| Commercial Multi-Surface Foaming Disinfectant (control) | 96.63 | 1.1 | A |
| X3-2 | 33.22 | 1.74 | B |
| X3-1 | 29.09 | 1.07 | C |
| X3-4 | 25.43 | 1.65 | D |
| X3-6 | 22.24 | 1.95 | D, E |
| X3-3 | 19.79 | 1.29 | E, F |
| X3-5 | 18.47 | 0.76 | F |

Example 4

Table 7 below shows the composition of two exemplary formulations of the present aqueous cleaning compositions. These formulations include a 1:1 mole ratio of N-decyl-N,N-dimethyl amine to citric acid as the ionic liquid component ("1:1 C10DMA:Citrate"). The amine salt may be added as a powdered solid or formed by adding the N-decyl-N,N-dimethyl amine and citric acid to water. The results of the Soap Scum Test ("SS") shown in Table 8 demonstrate the relative effectiveness of these formulations to remove soap scum from a hard surface.

TABLE 7

| | X4-1 Wt. % | X4-2 Wt. % |
|---|---|---|
| Water | 96.10 | 95.6 |
| Ethoxylated (7EO) C12 alcohol | 1.0 | 1.0 |
| 1:1 C10DMA:Citrate | 0.54 | 0.54 |
| Barquat MB-80 | 0.75 | 0 |
| Bardac 2250 | 0 | 1.20 |
| Citric Acid | 0.5 | 0.5 |
| Fragrance | 0.15 | 0.15 |
| IDSA | 1.0 | 1.0 |

TABLE 8

| Formulas Tested | Ave. % SS Removed | SD |
|---|---|---|
| Commercial (Mist) - control | 46.69 | 4.68 |
| Commercial (Foam) - control | 65.1 | 2.48 |
| X4-1 (Mist) | 55.79 | 1.52 |
| X4-1 (Foam) | 71.08 | 2.99 |
| X4-4 (Mist) | 50.02 | 1.37 |
| X4-4 (Foam) | 83.01 | 8.58 |

Example 5

Table 9 below shows the composition of a number of exemplary formulations of the present aqueous cleaning compositions. These formulations include a 3:1 mole ratio of N-decyl-N,N-dimethyl amine to citric acid as the ionic liquid component ("3:1 C10DMA:Citrate"). The amine salt may be added as a powdered solid or formed by adding the N-decyl-N,N-dimethyl amine and citric acid to water. The results of the Soap Scum Test ("SS") shown in Table 9 demonstrate the relative effectiveness of these formulations.

TABLE 9

| Experiment | 3:1 C10DMA:Citrate | 7EO-LA | Lauryl Amine Oxide | Sodium Octyl Sulfate | SS |
|---|---|---|---|---|---|
| 5-1 | 1.48 | 0 | 1.1 | 0 | 94.53 |
| 5-2 | 1.48 | 1 | 0 | 3.6 | 53.1 |
| 5-3 | 1.48 | 2 | 2.2 | 1.8 | 80.76 |
| 5-4 | 2.96 | 0 | 0 | 1.8 | 98.99 |
| 5-5 | 2.96 | 1 | 2.2 | 0 | 99.49 |
| 5-6 | 2.96 | 2 | 1.1 | 3.6 | 97.46 |
| C1 | 0 | 0 | 2.2 | 3.6 | 10.85 |
| C2 | 0 | 1 | 1.1 | 1.8 | 47.82 |
| C3 | 0 | 2 | 0 | 0 | 60.23 |

7EO-LA - Ethoxylated (7EO) lauryl alcohol

Example 6

Table 10 below shows the composition of a number of exemplary formulations of the present aqueous cleaning compositions. These formulations include an N-decyl-N,N-dimethyl amine/citrate salt as the ionic liquid component. The amine salt may be formed by adding the indicated amounts of N-decyl-N,N-dimethyl amine and citric acid to water.

TABLE 10

| Raw Material | Formulation 6-1 wt % | 6-2 wt % | 6-3 wt % | 6-4 wt % | 6-5 wt % |
|---|---|---|---|---|---|
| Water | 94-96.8 | ~95-99% | 94-99% | 95.7 | ~93-98 |
| C10DMA | 1.5 | 0.3-1.5 | 0.3-1.5 | 1.5 | 0.25-1.5 |
| Citric acid | 0.85 | 0.1-0.5 | — | 0.85 | 0.25-1.0 |
| Lactic acid | — | — | 0.1-2 | — | — |
| Ethoxylated C10-C15 alcohol | 2 | 0.1-2 | 0.1-2 | 2 | 0.75-2 |
| Antimicrobial Quat | 0.3 | 0.1-0.4 | 0.1-0.4 | — | 0.3-1.2 |
| IDSA | 0.2 | — | — | — | 0-2 |
| Na C8 Sulfate | 1 | — | — | — | — |
| Benzoisothiazolinone Preservative | 0.01 | — | — | — | 0.01 |
| Fragrance | 0.1 | 0.1-0.2 | 0.1-0.2 | — | 0.1-0.15 |
| pH | | 6-8 | | 4-6 | 6-8 |

Illustrative Embodiments

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

In one aspect, the aqueous cleaning composition may include (a) N,N-dialkyl-N-aliphatic ammonium hydroxycarboxylate salt; (b) nonionic surfactant and/or an anionic surfactant; (c) quaternary ammonium antimicrobial surfactant; and (d) at least about 85 wt. % water. Such cleaning compositions typically have a pH of about 5 to 8 and are substantially free of {e.g., contain no more than 0.1 wt. %} glycol ether solvents, aliphatic alcohol solvents, polyol solvents and amino alcohol solvents.

In one aspect, the aqueous cleaning composition may include (a) N,N-dialkyl-N-aliphatic ammonium hydroxycarboxylate salt; (b) nonionic surfactant and/or anionic surfactant; (c) quaternary ammonium antimicrobial surfactant; and (d) at least about 85 wt. % water. Such compositions typically have a pH of no more than about 8, e.g., a pH of about 5 to 8. The aqueous cleaning composition may be substantially free of glycol ether solvents, aliphatic alcohol solvents, polyol solvents and amino alcohol solvents. In some instances, other than an optional fragrance component, the composition is substantially free of volatile organic compounds. The aqueous cleaning composition may also include a polycarboxylate chelating agent, such as an aminopolycarboxylate chelating agent. The nonionic surfactant may be an ethoxylated alcohol non-ionic surfactant and/or an alkyl amine oxide non-ionic surfactant. The anionic surfactant may be an alkyl sulfate and/or alkyl sulfonate anionic surfactant. The N,N-dialkyl-N-aliphatic ammonium hydroxycarboxylate salt may include an N,N-dialkyl-N—($C_{8-18}$)—N-aliphatic ammonium hydroxycarboxylate salt, such as an N,N-di-($C_{1-3}$)alkyl-N-fatty ammonium hydroxycarboxylate salt. The N,N-dialkyl-N-aliphatic ammonium may suitably include an N,N-di-($C_{1-2}$)alkyl-N—($C_{8-14}$)-fatty ammonium hydroxycarboxylate salt, such as N,N-dimethyl-N-octylammonium citrate, N,N-dimethyl-N-decylammonium citrate, N,N-dimethyl-N-dodecylammonium citrate and/or N,N-dimethyl-tetradecylammonium citrate. In some embodiments, the N,N-di-($C_{1-2}$)alkyl-N—($C_{8-14}$)-fatty ammonium hydroxycarboxylate salt may suitably include an N,N-dimethyl-N-n-octyl ammonium citrate, N,N-dimethyl-N-n-decyl ammonium citrate, N,N-dimethyl-N-lauryl ammonium citrate and/or N,N-dimethyl-myristyl ammonium citrate. In other embodiments, the N,N-di-($C_{1-2}$)alkyl-N—($C_{8-14}$)-fatty ammonium hydroxycarboxylate salt may include N,N-dimethyl-N-n-octyl ammonium lactate, N,N-dimethyl-N-n-decyl ammonium lactate, N,N-dimethyl-N-lauryl ammonium lactate and/or N,N-dimethyl-myristyl ammonium lactate.

In another aspect, the aqueous cleaning composition may include (a) N,N-dialkyl-N-aliphatic ammonium hydroxycarboxylate salt; (b) nonionic surfactant; (c) aminopolycarboxylate chelating agent; (d) quaternary ammonium antimicrobial surfactant; and (e) at least about 85 wt. % water. The aminopolycarboxylate chelating agent may include iminodisuccinate salt (IDSA), ethylenediaminetetraacetate (EDTA) salt, hydroxyethylethylenediaminetriacetate (HEEDTA) salt, 2-hydroxyethyliminodiacetate (HEIDA) salt, nitrilotriacetate (NTA) salt, glutamate diacetic acid salt, diethylenetriaminepentaacetic acid salt, (DETAPA), triethylenetetraminehexaacetic acid salt (TETAHA), 1,3-diamino-2-hydroxypropane-N,N,N',N'-tetraacetic acid salt, and/or 1,2-diaminocyclohexane-N,N,N',N'-tetraacetic acid salt. Suitably, the aminopolycarboxylate chelating agent includes a sodium salt of iminodisuccinic acid and/or a sodium salt of glutamate diacetic acid. Such aqueous cleaning compositions may be substantially free of glycol ether solvents, aliphatic alcohol solvents, polyol solvents and amino alcohol solvents. In some embodiments, other than an optional fragrance component, the aqueous cleaning compositions may be substantially free of volatile organic compounds.

In another aspect, the aqueous cleaning composition may include (a) N,N-di-alkyl-N-aliphatic ammonium hydroxycarboxylate salt; (b) ethoxylated alcohol non-ionic surfactant; (c) chelating agent; (d) quaternary ammonium antimicrobial surfactant; and (e) at least about 85 wt. % water; wherein the composition has a pH of about 6 to 8. Often, the N,N-dialkyl-N-aliphatic ammonium hydroxycarboxylate salt may suitably include N,N-dimethyl-N-n-decylammonium citrate. The chelating agent may include an aminopolycarboxylate chelating agent, such as a sodium salt of iminodisuccinic acid and/or a sodium salt of glutamate diacetic acid.

In another aspect, the aqueous cleaning composition may include (a) N,N-di-alkyl-N-aliphatic ammonium hydroxycarboxylate salt; (b) nonionic surfactant; (c) quaternary ammonium antimicrobial surfactant; and (d) at least about 75 wt. % water. Such compositions typically have a pH of no more than about 8. Such aqueous cleaning compositions may be substantially free of glycol ether solvents, aliphatic alcohol solvents, polyol solvents and amino alcohol solvents. In some embodiments, other than an optional fragrance component, the aqueous cleaning compositions may be substantially free of volatile organic compounds. In some instances, the aqueous cleaning composition may also include a chelating agent.

In many instances, the aqueous cleaning composition described herein may include the following weight percent of the various components.

| Raw Material | Wt % |
|---|---|
| Water | 75-97 |
| Ionic liquid | 0.1-5 |
| Nonionic surfactant | 0.1-5 |
| Quat. ammonium antimicrobial surfactant | 0.1-0.5 |
| Hydroxycarboxylic acid chelating agent | 0-1 |
| Aminopolycarboxylate chelating agent | 0-10 |
| Preservative | 0-0.1 |
| Fragrance | 0-0.3 |
| pH | 6-8 |

In another aspect, the aqueous cleaning composition may include (a) about 0.1 to 4 wt. % N,N-dimethyl-N-n-decylammonium citrate; (b) about 0.1 to 0.5 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)dimethylammonium chloride; (c) about 0.2 to 5 wt. % ethoxylated $C_{10-15}$-alkanol having an average degree of ethoxylation of about 6 to 10; (d) about 0.2 to 5 wt. % iminodisuccinate salt and/or glutamate diacetic acid salt; and (e) at least about 85 wt. % water. Such compositions may have a pH of about 6 to 8 and, other than an optional fragrance component, the compositions may be substantially free of volatile organic compounds.

In another aspect, the aqueous cleaning composition may include (a) about 0.05 to 3 wt. % N,N-dialkyl-N-aliphatic ammonium hydroxycarboxylate salt, which comprises N,N-dimethyl-N-n-decylammonium citrate; (b) about 0.1 to 1 wt. % quaternary ammonium antimicrobial surfactant, which comprises N-(n-$C_{12-16}$)-alkyl-N-benzyl dimethylammonium halide, N-(n-$C_{12-16}$)-alkyl-N-ethylbenzyl dimethylammonium halide and/or bis(n-$C_{8-12}$-alkyl)dimethylammonium halide; (c) about 0.2 to 5 wt. % nonionic surfactant, which comprises ethoxylated $C_{10-15}$-alkanol having an average degree of ethoxylation of about 6 to 10; (d) about 0.2 to 2 wt. % aminopolycarboxylate chelating agent, which comprises iminodisuccinate salt and/or glutamate diacetic acid salt; and (e) at least about 90 wt. % water. Such compositions may desirably have a pH of about 6 to 8.

In another aspect, the aqueous cleaning composition may include (a) about 0.1 to 4 wt. % N,N-dimethyl-N-n-decylammonium citrate; (b) about 0.1 to 1 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)dimethylammonium chloride; (c) about 0.2 to 5 wt. % ethoxylated having an average degree of ethoxylation of about 6 to 10; (d) about 0.2 to 2 wt. % iminodisuccinate salt and/or glutamate diacetic acid salt; and (e) at least about 90 wt. % water. Such compositions may have a pH of about 6 to 8 and other than an optional fragrance component the composition is substantially free of volatile organic compounds.

In another illustrative embodiment, the present cleaning composition may (a) N,N-dialkyl-N-aliphatic ammonium hydroxycarboxylate salt; (b) anionic surfactant; (c) quaternary ammonium antimicrobial surfactant; and (d) at least about 85 wt. % water. Such compositions may have a pH of about 6 to 8 and other than an optional fragrance component the composition is substantially free of volatile organic compounds. The quaternary ammonium antimicrobial surfactant may include N-(n-$C_{12-16}$)-alkyl-N-benzyl dimethylammonium halide, N-(n-$C_{12-16}$)-alkyl-N-ethylbenzyl dimethylammonium halide and/or bis(n-$C_{8-12}$-alkyl) dimethylammonium halide. The anionic surfactant may include an alkyl sulfate salt and/or alkyl sulfonate salt. For example, the anionic surfactant may include sodium octyl sulfate and/or sodium lauryl sulfate.

In one illustrative embodiment, the present cleaning composition includes (a) N,N-dialkyl-N-aliphatic ammonium hydroxycarboxylate salt; (b) nonionic surfactant and/or an anionic surfactant; (c) quaternary ammonium antimicrobial surfactant; and (d) at least about 85 wt. % water; wherein the composition has a pH of about 5 to 8 and is substantially free {e.g., ≤0.1 wt. %} of glycol ether solvents, aliphatic alcohol solvents, polyol solvents and amino alcohol solvents. Often, other than an optional fragrance component, the composition is substantially free of volatile organic compounds, e.g., contain ≤0.1 wt. % VOC. The anionic surfactant may include alkylsulfate salt (e.g., sodium lauryl sulfate and/or sodium octyl sulfate) and/or alkylsulfonate salt. The nonionic surfactant may include ethoxylated aliphatic alcohol, such as an ethoxylated $C_{10-15}$-alkanol having an average degree of ethoxylation of about 6 to 10. In some instances, nonionic surfactant may include an alkyl amine oxide, e.g., N-lauryl-N,N-dimethyl amine oxide, N-myristyl-N,N-dimethyl amine oxide and/or N-decyl-N,N-dimethyl amine oxide.

While certain embodiments have been illustrated and described, it should be understood that changes and modifications can be made therein in accordance with ordinary skill in the art without departing from the technology in its broader aspects.

The embodiments, illustratively described herein may suitably be practiced in the absence of any element or elements, limitation or limitations, not specifically disclosed herein. Thus, for example, the terms "comprising," "including," "containing," shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof.

What is claimed is:

1. An aqueous cleaning composition comprising: (a) N,N-dialkyl-N-aliphatic ammonium hydroxycarboxylate salt; (b) nonionic surfactant; (c) quaternary ammonium antimicrobial surfactant; and (d) at least about 85 wt. % water.

2. The composition of claim 1, wherein the composition contains no more than 0.1 wt. % glycol ether solvents, aliphatic alcohol solvents, polyol solvents and amino alcohol solvents.

3. The composition of claim 1, wherein, other than an optional fragrance component, the composition contains no more than 0.1 wt. % volatile organic compounds.

4. The composition of claim 1, further comprising an aminopolycarboxylate chelating agent.

5. The composition of claim 1, wherein the nonionic surfactant is an ethoxylated $C_{8-16}$-aliphatic alcohol having an average degree of ethoxylation of about 5 to 12 as a nonionic surfactant.

6. The composition of claim 1, wherein the nonionic surfactant comprises an alkyl amine oxide nonionic surfactant.

7. The composition of claim 1, wherein the composition has a pH of about 5 to 8.

8. The composition of claim 1, wherein the N,N-dialkyl-N-aliphatic ammonium hydroxycarboxylate salt comprises N,N-di-($C_{1-3}$)alkyl-N—($C_{8-18}$)—N-aliphatic ammonium hydroxycarboxylate salt.

9. The composition of claim 8, wherein the N,N-dialkyl-N-aliphatic ammonium hydroxycarboxylate salt is selected from the group consisting of N,N-dimethyl-N-n-octyl ammonium citrate, N,N-dimethyl-N-n-decyl ammonium citrate, N,N-dimethyl-N-lauryl ammonium citrate, N,N-dimethyl-myristyl ammonium citrate, N,N-dimethyl-N-n-octyl ammonium lactate, N,N-dimethyl-N-n-decyl ammonium lactate, N,N-dimethyl-N-lauryl ammonium lactate and/or N,N-dimethyl-myristyl ammonium lactate.

10. The composition of claim 4, further comprising an aminopolycarboxylate chelating agent selected from the group consisting of iminodisuccinate salt (IDSA), ethylenediaminetetraacetate (EDTA) salt, hydroxyethylethylenediaminetriacetate (HEEDTA) salt, 2-hydroxyethyliminodiacetate (HEIDA) salt, nitrilotriacetate (NTA) salt, glutamate diacetic acid salt, diethylenetriaminepentaacetic acid salt (DETAPA), triethylenetetraminehexaacetic acid salt (TETAHA), 1,3-diamino-2-hydroxypropane-N,N,N',N'-tetraacetic acid salt, and/or 1,2-diaminocyclohexane-N,N,N',N'-tetraacetic acid salt.

11. The composition of claim 4, wherein the aminopolycarboxylate chelating agent comprises a sodium salt of iminodisuccinic acid and/or a sodium salt of glutamate diacetic acid.

12. The composition of claim 1, wherein the N,N-dialkyl-N-aliphatic ammonium hydroxycarboxylate salt comprises a salt of citric acid, tartaric acid, lactic acid, glucaric acid, gluconic acid and/or malic acid.

13. The composition of claim 4, wherein the composition comprises:

(a) about 0.1 to 4 wt. % N,N-dialkyl-N-aliphatic ammonium hydroxycarboxylate salt;
(b) about 0.1 to 1 wt. % quaternary ammonium antimicrobial surfactant;
(d) about 0.2 to 5 wt. % nonionic surfactant; and
(e) about 0.2 to 2 wt. % aminopolycarboxylate chelating agent; and
(f) at least about 90 wt. % water.

14. The composition of claim 1, wherein the N,N-dialkyl-N-aliphatic ammonium hydroxycarboxylate salt comprises N,N-di-alkyl-N—($C_{8-14}$)-fatty ammonium citrate;

the nonionic surfactant comprises ethoxylated $C_{10-15}$-aliphatic alcohol having an average degree of ethoxylation of about 5 to 12;
the aminopolycarboxylate chelating agent comprises iminodisuccinate salt and/or glutamate diacetic acid salt;
the quaternary ammonium antimicrobial surfactant comprises quaternary benzyl ammonium salt and/or a bis(n-alkyl)dimethylammonium salt; and
the composition has a pH of about 5 to 8.

15. The composition of claim 1, wherein the N,N-dialkyl-N-aliphatic ammonium hydroxycarboxylate salt comprises N,N-dimethyl-N—($C_{8-14}$)-n-alkylammonium citrate and/or N,N-dimethyl-N—($C_{8-14}$)-n-alkylammonium lactate.

16. The composition of claim 4, wherein the composition comprises:

(a) about 0.1 to 4 wt. % N,N-dimethyl-N—($C_{8-14}$)-n-alkyl ammonium citrate;
(b) about 0.1 to 1 wt. % quaternary ammonium antimicrobial surfactant;
(c) about 0.2 to 5 wt. % ethoxylated alcohol nonionic surfactant;
(d) about 0.2 to 2 wt. % aminopolycarboxylate chelating agent; and
(e) at least about 90 wt. % water; wherein, other than an optional fragrance component, the composition contains no more than 0.1 wt. % volatile organic compounds.

17. An aqueous cleaning composition comprising:

(a) about 0.05 to 3 wt. % N,N-dialkyl-N-aliphatic ammonium hydroxycarboxylate salt, which comprises N,N-dimethyl-N-n-decylammonium citrate;
(b) about 0.1 to 1 wt. % quaternary ammonium antimicrobial surfactant, which comprises N-(n-$C_{12-16}$)-alkyl-N-benzyl dimethylammonium halide, N-(n-$C_{12-16}$)-alkyl-N-ethylbenzyl dimethylammonium halide and/or bis(n-$C_{8-12}$-alkyl)dimethylammonium halide;
(c) about 0.2 to 5 wt. % nonionic surfactant, which comprises ethoxylated $C_{10-15}$-alkanol having an average degree of ethoxylation of about 6 to 10;

(d) about 0.2 to 2 wt. % aminopolycarboxylate chelating agent, which comprises iminodisuccinate salt and/or glutamate diacetic acid salt; and (e) at least about 90 wt. % water; wherein the composition has a pH of about 6 to 8 and, other than an optional fragrance component, the composition contains no more than 0.1 wt. % volatile organic compounds.

18. An aqueous cleaning composition comprising: (a) N,N-dialkyl-N-aliphatic ammonium hydroxycarboxylate salt; (b) anionic surfactant; (c) quaternary ammonium antimicrobial surfactant; and (d) at least about 85 wt. % water.

19. A method for cleaning a hard surface having a first concentration of soap scum thereon, the method comprising applying the composition of claim 1 to the hard surface; and removing the composition from the hard surface, such that after removal the hard surface has a second concentration of soap scum, which is no more than about 50% of the first concentration of soap scum.

20. The composition of claim 1, wherein the N,N-dialkyl-N-aliphatic ammonium hydroxycarboxylate salt is formed from a reaction of a 3:1 mole ratio of an N,N-dialkyl-N-aliphatic tertiary amine and citric acid.

21. The composition of claim 18, wherein the anionic surfactant is an alkyl sulfate anionic surfactant and/or an alkyl sulfonate anionic surfactant.

* * * * *